US008752256B2

(12) United States Patent
Verpoort et al.

(10) Patent No.: US 8,752,256 B2
(45) Date of Patent: Jun. 17, 2014

(54) METHOD FOR PREPARING A SURFACE FOR APPLYING A THERMALLY SPRAYED LAYER

(75) Inventors: Clemens Maria Verpoort, Monheim (DE); Mark Robert Silk, Pulheim (DE); Spencer James Lindon, West Midlands (GB)

(73) Assignee: Ford Global Technologies, LLC, Dearborn, MI (US)

( * ) Notice: Subject to any disclaimer, the term of this patent is extended or adjusted under 35 U.S.C. 154(b) by 276 days.

(21) Appl. No.: 12/935,671

(22) PCT Filed: Apr. 20, 2009

(86) PCT No.: PCT/EP2009/054670

§ 371 (c)(1),
(2), (4) Date: Sep. 30, 2010

(87) PCT Pub. No.: WO2009/130184

PCT Pub. Date: Oct. 29, 2009

(65) Prior Publication Data

US 2011/0030663 A1 Feb. 10, 2011

(30) Foreign Application Priority Data

Apr. 21, 2008 (DE) ..... 10 2008 019 933

(51) Int. Cl.
*B21C 37/30* (2006.01)

(52) U.S. Cl.
USPC ..... 29/90.01; 123/668; 29/81.02

(58) Field of Classification Search
CPC ..... B32B 3/30; C23C 4/02; B24B 9/04; B24D 13/10; F02F 1/00; B23P 9/02
USPC ..... 29/81.02, 81.021, 81.12, 81.15, 90.1, 29/557, 90.01; 123/668; 72/40; 15/198, 15/236.1
See application file for complete search history.

(56) References Cited

U.S. PATENT DOCUMENTS 3,324,496 A * 6/1967 Haracz ..... 15/183
4,324,017 A 4/1982 Viehe (Continued)

FOREIGN PATENT DOCUMENTS

DE 19919024 A1 11/2000
DE 60131096 T2 2/2008

(Continued)

OTHER PUBLICATIONS

International Patent Bureau, International Search Report for the corresponding German Patent Application No. DE 10 2008 019 933.8 filed Apr. 21, 2008 and the PCT/EP2009/054670 filed Apr. 20, 2009.

(Continued)

*Primary Examiner* — David Bryant
*Assistant Examiner* — Ruth G Hidalgo-Hernande
(74) *Attorney, Agent, or Firm* — Damian Porcari; Brooks Kushman P.C.

(57) ABSTRACT

A method for preparing a surface, previously roughed in a mechanical manner and comprising sharp-edged ridges and recesses, on metal workpieces for applying a thermally sprayed layer. The roughened layer is machined by hammer or percussion brushes with a rapidly rotating hammer or percussion brush having a plurality of resilient percussion wires that are oriented in a radially outward manner, such that the edges of the ridges are broken in order to improve the adhesion of the subsequently applied thermally sprayed layer or are at least curved forming rear sections. The brush rotates at a high rotational speed of approximately 3000-6000 rotations per minute and is displaced laterally with its rotational axis being at a parallel distance that remains constant in relation to the surface of the workpiece such that percussion wires distributed on the periphery of the brush impact with the ends thereof of the surface areas adjacent to the workpiece at an oblique angle that is less than 90° in rapid succession. The brush consists of an essentially cylindrical rotationally symmetrical brush body having a plurality of support bars that are parallel to the axis, that are mounted on the periphery of the brush between front-sided brush disks.

8 Claims, 6 Drawing Sheets

(56) References Cited

U.S. PATENT DOCUMENTS

| | | | | |
|---|---|---|---|---|
| 4,646,479 | A * | 3/1987 | Walker et al. | 451/59 |
| 5,107,967 | A | 4/1992 | Fujita et al. | |
| 5,239,955 | A | 8/1993 | Rao et al. | |
| 5,332,422 | A | 7/1994 | Rao | |
| 5,363,821 | A | 11/1994 | Rao et al. | |
| 5,480,497 | A | 1/1996 | Zaluzec et al. | |
| 5,481,084 | A | 1/1996 | Patrick et al. | |
| 5,622,753 | A * | 4/1997 | Shepley et al. | 427/453 |
| 5,691,004 | A * | 11/1997 | Palazzolo et al. | 427/455 |
| 5,820,938 | A | 10/1998 | Pank et al. | |
| 5,931,038 | A | 8/1999 | Higashi | |
| 5,958,521 | A | 9/1999 | Zaluzec et al. | |
| 5,997,286 | A | 12/1999 | Hemsath et al. | |
| 6,328,026 | B1 | 12/2001 | Wang et al. | |
| 6,395,090 | B1 | 5/2002 | Shepley et al. | |
| 6,589,605 | B2 | 7/2003 | Shepley et al. | |
| 6,622,685 | B2 | 9/2003 | Takahashi et al. | |
| 6,863,931 | B2 | 3/2005 | Someno et al. | |
| 7,089,662 | B2 * | 8/2006 | Izquierdo et al. | 29/888.061 |
| 7,165,430 | B2 | 1/2007 | Weidmer | |
| 7,188,416 | B1 | 3/2007 | Woehlke et al. | |
| 7,415,958 | B2 | 8/2008 | Boehm et al. | |
| 7,568,273 | B2 | 8/2009 | Lizumi et al. | |
| 7,607,209 | B2 | 10/2009 | Iizumi et al. | |
| 7,851,046 | B2 | 12/2010 | Nishimura et al. | |
| 7,862,404 | B2 | 1/2011 | Takashima et al. | |
| 8,209,831 | B2 | 7/2012 | Boehm et al. | |
| 2004/0079556 | A1 | 4/2004 | Cramer et al. | |
| 2005/0064146 | A1 * | 3/2005 | Hollis et al. | 428/167 |
| 2007/0012177 | A1 | 1/2007 | Miyamoto et al. | |
| 2008/0252412 | A1 | 10/2008 | Larsson et al. | |
| 2008/0260958 | A1 * | 10/2008 | Sekikawa et al. | 427/448 |
| 2009/0175571 | A1 * | 7/2009 | Boehm et al. | 384/625 |
| 2010/0031799 | A1 | 2/2010 | Ast et al. | |
| 2010/0101526 | A1 * | 4/2010 | Schaefer et al. | 123/193.2 |
| 2010/0139607 | A1 | 6/2010 | Herbst-Dederichs et al. | |
| 2011/0000085 | A1 | 1/2011 | Kanai et al. | |
| 2011/0023777 | A1 | 2/2011 | Nishimura et al. | |
| 2011/0297118 | A1 | 12/2011 | Izawa et al. | |
| 2012/0018407 | A1 | 1/2012 | Schramm et al. | |

FOREIGN PATENT DOCUMENTS

| | | | |
|---|---|---|---|
| DE | 102006045275 | B3 | 2/2008 |
| DE | 102008022225 | A1 | 11/2009 |
| DE | 102008024313 | A1 | 12/2009 |
| DE | 102008058452 | A1 | 2/2010 |
| DE | 102009008741 | A1 | 8/2010 |
| EP | 0903422 | A1 | 3/1999 |
| EP | 0919715 | A2 | 6/1999 |
| EP | 0816527 | B1 | 7/2000 |
| EP | 1559807 | A1 | 1/2005 |
| EP | 1504833 | A1 | 2/2005 |
| EP | 1854903 | A1 | 11/2007 |
| JP | 1-246352 | A | 10/1989 |
| JP | 08111582 | A | 4/1996 |
| JP | 2005336556 | A | 12/2005 |
| JP | 2006097045 | A | 4/2006 |
| JP | 2006097046 | A | 4/2006 |
| JP | 2007277607 | A | 10/2007 |
| RU | 2297314 | C2 | 4/2007 |
| SU | 1310181 | A1 | 5/1987 |
| WO | 0037789 | A1 | 6/2000 |
| WO | 2005040446 | A1 | 6/2005 |
| WO | 2005273425 | A1 | 8/2005 |
| WO | 2006061710 | A1 | 6/2006 |
| WO | 2007007821 | A1 | 1/2007 |
| WO | 2007087989 | A1 | 8/2007 |
| WO | 2008034419 | | 3/2008 |
| WO | 2011161346 | A1 | 12/2011 |

OTHER PUBLICATIONS

European Patent Office, European Search Report for the corresponding EP Application No. 10167055.2 mailed Oct. 11, 2011.

C. Werporrt, W. Blume, R Ehrenpreis, Ford Motor Company, ICES-2006-1391, Proceedings of ICES2006, Therma Spraying of Aluminum Cylinder Bores by the Ford PTWA Spray Process, 2006 Internal Combustion Engine Division Spring Technical Conference May 7-10, 2006, Aachen, Germany.

Eberhard Kretzschmar, The Metal Spraying Process and its Application in our history, Veb Carl Marhold Publishing House, Halle (Salle), 1953.

German Patent and Trademark Office, German Search Report for the corresponding German Patent Application No. DE 10 2009 027 200. 3-45 mailed Mar. 8, 2010.

* cited by examiner

METHOD FOR PREPARING A SURFACE FOR APPLYING A THERMALLY SPRAYED LAYER

BACKGROUND

1. Field

The invention relates to a process for preparing a surface on a metal workpiece for the application of a thermally sprayed layer, to a hammer or percussion brush for carrying out the process, and also to a workpiece produced according to said process.

2. Background Art

It is known that surfaces on metal workpieces intended for coating by thermal spraying have to be prepared appropriately. This can be carried out by roughening the surface. Various processes are employed for this purpose in industry, such as sand-blasting, high-pressure water jetting, brushing, milling and similar machining processes. However, these machining processes are associated with problems. For example, chips and remnants from the machining processes can remain in grooves and channels on the machined surfaces and lead to problems if they are covered and incorporated by the coating and this layer has then been honed. The depth of the grooves and channels, which have been produced by mechanical roughening, is about 100 μm. This region is flat and smooth, and therefore the thermally sprayed layer cannot readily adhere at these sites.

In cases where an engine has to be repaired by means of thermal spraying during service work, it is necessary to machine an inner zone of wear within the cylinder bore, a region having the original, smooth surface structure, which is honed for example, remaining above and underneath said zone. If a cylinder bore of this type is repaired by means of thermal spraying, the coating cannot adhere to the honed surface. Repair by means of thermal spraying is difficult particularly for engine blocks consisting of an aluminum alloy with cast-in cylinder liners owing to the aluminum lip overlapping the cylinder liner and owing to the region between the aluminum lip and the surface region on the cylinder liner to be coated. Mechanical roughening results in residual expansion stresses, and these reduce the fatigue strength of the workpiece.

A known process is also the preparation of the surface by sand-blasting with corundum particles and subsequent cleaning, before the surface coating can be applied by means of thermal spraying. In addition to the comparatively complex process step of surface cleaning, a significant disadvantage of sand-blasting with corundum particles is, in particular, that extremely small corundum particles penetrate into the surface to be coated, and can remain there despite intensive cleaning. After the surface coating has been applied, blasting particles of this type may impair the tensile adhesive strength of the coating on the previously cleaned surface considerably.

Moreover, particles of the abrasive material can also adhere to surface regions of the workpiece to be coated which are not coated and accordingly have not been blasted previously either. Abrasive material particles of this type may result in considerable problems when the workpiece is used. This can occur, for example, on the cylinder running faces of engines which have been processed in this form. Corundum particles which have remained in or on the engine components can thus result in considerable problems and, under certain circumstances, cause the engine to fail.

In order to remedy this, DE 198 40 117 A1 discloses a process for the material-removing machining of surfaces on the inner side of hollow bodies as a preparation for the application of a thermally sprayed layer, in which process some of the material which forms the inner side of the hollow bodies is removed and a surface having a defined structure and/or quality is produced. However, this known process has the disadvantage that it cannot be used to produce surface profiles having a saw-tooth effect and thus undercuts. However, since surface structures of this type provide decisive advantages with respect to the tensile adhesive strength of the thermally applied coating, this is a decisive disadvantage. In addition, the material-removing process cannot provide consistency in terms of the surface values, since the machining tools are subjected to a necessary amount of wear and thus also produce a surface structure which varies as the workpiece becomes worn. In addition, the material removal has a negative effect on the mechanical strength of the surface prepared by this process.

Furthermore, DE 27 12 863 A1 describes a percussion tool for the removal of material from surfaces, said percussion tool bearing, at one end, a bundle of metallic material-removing needles which oscillate in the longitudinal direction thereof and can thus strike in quick succession against a surface. Needle appliances of this type are usually used to remove rust or paint from surfaces. However, needle appliances of this type are also used for cleaning concrete structural parts.

SUMMARY

It is an object of the invention to eliminate the above-described problems when preparing a surface on a metal workpiece for the application of a thermally sprayed layer in a specific surface region.

Compared to conventional brushing, the combination of mechanical roughening and brushing provides a surface structure having properties very similar to those obtained by sand-blasting or corundum-blasting or shot-blasting, i.e. bombardment with shot or some other suitable abrasive material. In this process, the brush rotates at a very high rotational speed of about 3000 to 6000 revolutions per minute, as a result of which the percussion wires transfer a large amount of local energy to the surface of the workpiece. This results in plastic deformation and an increased degree of roughness only in the machined surface region of the workpiece, the sharp-edged burrs on the roughened surface being broken in order to improve the adhesion of the subsequently applied thermally sprayed layer or being at least partially bent over to form undercuts. In the process, chips and remnants are also removed from the machined surface regions, and this results in further improved adhesion and thus an increased surface strength of the sprayed coating.

This is the case, in particular, when the sharp-edged burrs and depressions on the mechanically roughened surface are grooves formed by machining, and the percussion wires impinge predominantly parallel to the grooves. When a percussion wire impinges on the surface of a groove web formed between the grooves, kinetic energy which leads to plastic deformation of the surface of the groove web is transferred, as a result of which the material of the groove web flows into the region of at least one of the grooves on either side. This can also be considered to be a locally delimited flange of the groove web in the direction of the groove, as a result of which the undercut required to increase the adhesive strength is formed.

Since the percussion wires impinge parallel to the grooves, an advantageous form of the undercuts is produced because the material of the groove webs thereby flows predominantly transversely in relation to the grooves and an advantageous form of the undercuts is thus produced. In this context, predominantly parallel is to be understood as meaning that the percussion wires move in a direction predominantly parallel to the groove direction. This is the case, for example, when, in the case of a rotating brush, the axis of rotation of the brush is oriented predominantly parallel to the surface and predominantly transversely in relation to the groove direction.

The grooves are produced as channels when, for example, the surface is subjected to turning, drilling or milling, for example when machining cylinder bores. Equally, the grooves can also be introduced by rolling or pressing. Within the context of this application, all processes which introduce an appropriate groove structure into the surface are suitable for producing the mechanically roughened surface.

The grooves advantageously have a trapezoidal to rectangular cross section. In the case of this cross-sectional form, the undercuts required are formed very easily if the percussion wires impinging in a parallel manner deform the edges and burrs of the groove webs transversely in relation to the groove direction. Particularly given a rectangular cross section, only minor deformations of the groove web transversely in relation to the groove direction are required for forming the undercuts. A trapezoidal cross section has the advantage that it is easy to produce, and nevertheless the undercuts required can be produced by the percussion brushing.

The diameter of the percussion wires is advantageously greater than the groove width. Here, the groove width is considered to be the average distance between the groove webs. In this case, the percussion wires can never impinge on the base of the grooves, which would be possible in theory in the case of parallel brushing, but instead will always impinge on at least one groove web in order to produce the undercut there.

In this case, the diameter of the percussion wires can also correspond to at least one times the groove spacing, preferably two to three times the groove spacing. Percussion wires of this type will always strike one groove web, but can also strike two groove webs. A wide undercut is formed owing to the relatively large diameter in relation to the groove spacing, since a large region of a groove web is plastically deformed. The groove spacing should be understood as meaning the distance from groove center to groove center or from groove web center to groove web center.

The ratio of groove depth to groove width is advantageously between 0.2 and 1, preferably between 0.5 and 0.7. The groove depth is understood to mean the average distance between the surface of the groove web and the base of the groove. Given these proportions, the grooves can be readily introduced into the surface and nevertheless have a sufficient depth to bring about sufficient interlocking of the layer to be applied by spraying with the undercuts produced. Excessively deep grooves might not be filled by the spraying material; in the case of excessively shallow grooves, the undercuts would be useless since the spraying material would not reach behind them.

The ratio of groove spacing to groove width is advantageously between 1.2 and 4, preferably between 1.8 and 2.2. In this context, the groove spacing is the average groove width plus the average width of the groove webs. Groove webs and the grooves therefore have similar widths. The widths can then be selected such that firstly good filling of the grooves with the spraying material is ensured, and secondly the width of the groove web is sufficient to bond the sprayed layer firmly to the base material.

The groove spacing is advantageously between 0.1 mm and 1 mm, preferably between 0.15 mm and 0.25 mm. The resulting grooves and groove webs are simple to produce, can be deformed in a favorable manner for the undercuts with the percussion wires, can readily be filled with the spraying material and have a sufficient strength to hold the sprayed layer.

The combined hammer brushing process also produces residual compressive stresses in the machined surface regions, as a result of which the fatigue strength of the various components is increased. In order to improve the machining quality and the long-term strength, the percussion wires or limb springs of the hammer or percussion brush are provided with a hard diffusion chromium plating containing about 53% chromium in the surface of the wires, corresponding to a Vickers hardness HV of about 1800, such that the service life of the brush is as high as possible and any contamination of steel with aluminum carriers, which might otherwise lead to galvanic corrosion problems, is prevented.

It is also particularly advantageous if the surface machining is carried out, in particular when repairing engine blocks, only in the region of the worn cylinder running faces, and the honed cylinder faces still present thereabove and/or therebeneath remain unmachined. This prevents adhesion problems for the coating which can frequently otherwise occur in the case of an excessively thin coating in the honed surface regions. The process according to the invention allows the regions to be coated to be machined very effectively without damaging or also roughening the adjacent, honed cylinder face.

Therefore, it is possible only in the region of the worn cylinder running face to apply a thermally sprayed layer which, owing to the surface machining with the percussion brush, adheres very well to the engine block. In particular, the process according to the invention is suitable for preparing a thermally sprayed layer produced by the PTWA wire-plasma spraying process.

BRIEF DESCRIPTION OF THE DRAWINGS

Preferred exemplary embodiments of a hammer or percussion brush for carrying out the process according to the invention are shown schematically in the drawing, in which:

FIG. 10 shows, in an enlarged excerpt X from FIG. 9, the design and mode of operation of the percussion wires of brushes of this type when machining surfaces on workpieces according to the process according to the invention, whereas

DETAILED DESCRIPTION OF THE EMBODIMENTS

Figure 1:
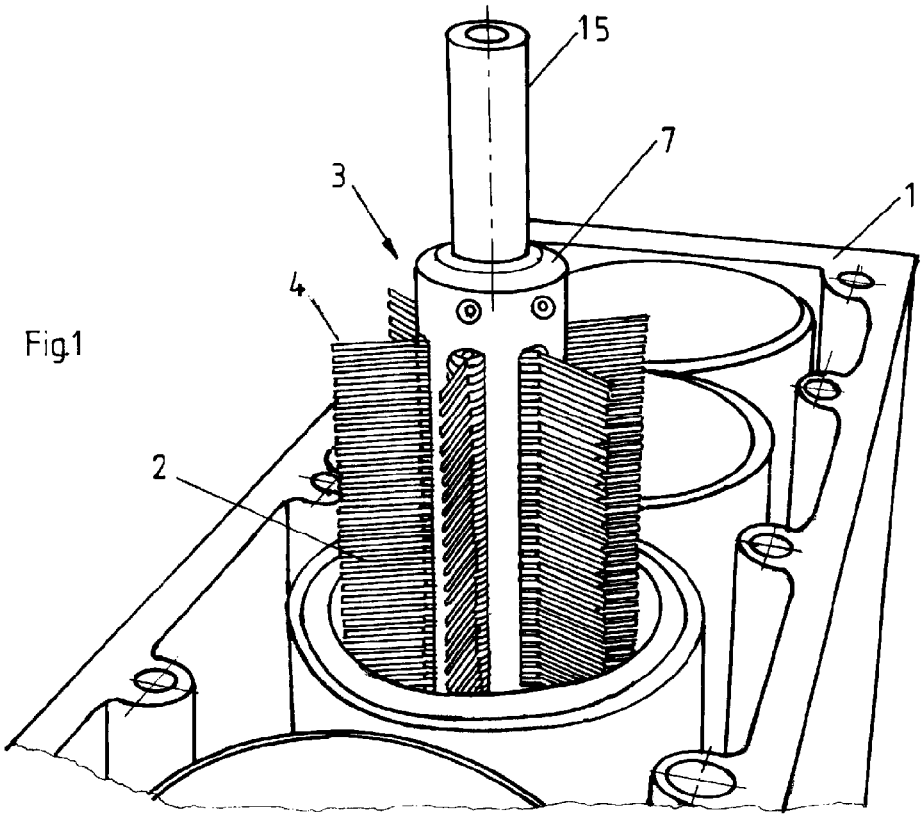
FIG. 1 shows the use of a hammer or percussion brush when machining cylinder liners on internal combustion engines.
Figure 2:
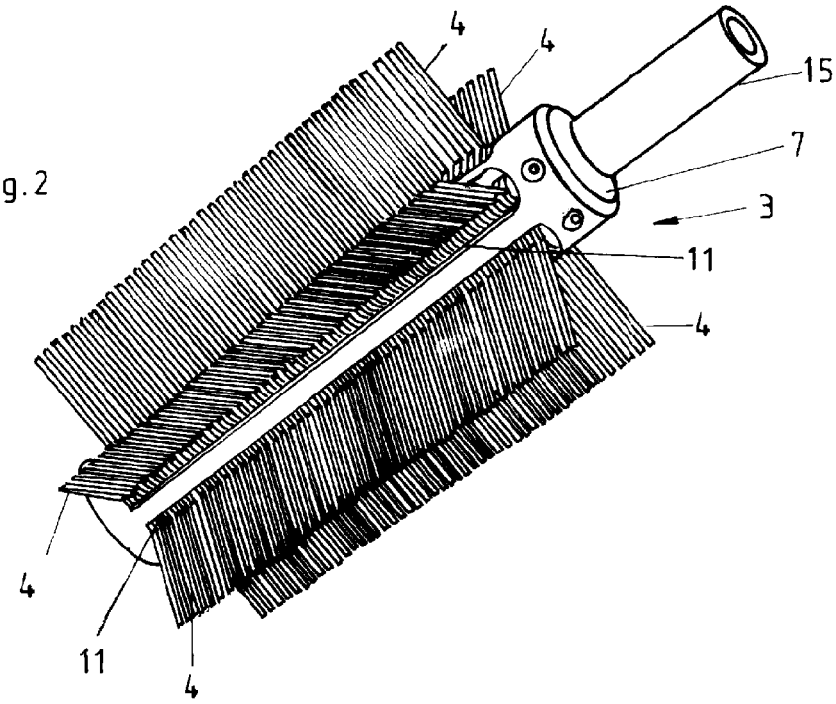
FIG. 2 shows a perspective side view of a brush of this type.
Figure 3:
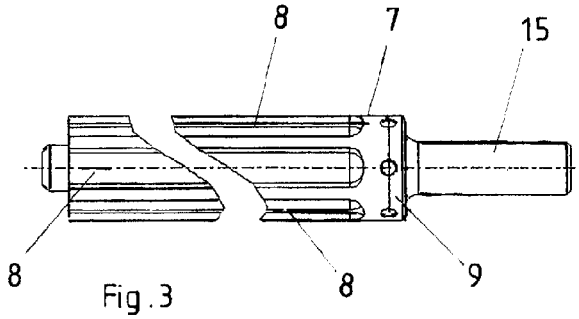
FIG. 3 and FIG. 3*a* show the brush body of a brush of this type in a side view and an associated end view.
Figure 3A:
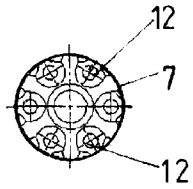
Figure 4:
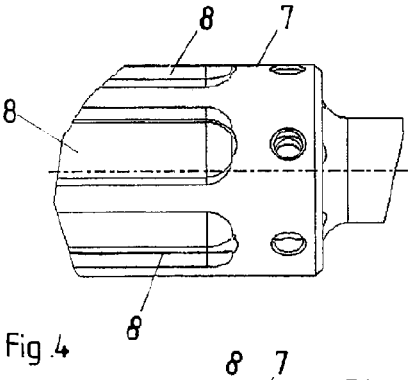
FIG. 4 and FIG. 4*a* show a partial side view of the brush body and an associated end view, enlarged compared to FIG. 3 and FIG. 3*a*, FIG. 5 and FIG. 5*a* show a partial side view of the brush body and a sectional illustration according to section line V-V shown in FIG. 5, FIG. 6 and FIG. 6*a* show an end view of a brush disk positioned at the end as shown in the previous figures and a sectional illustration according to section line VI-VI shown in FIG. 6, FIG. 7 and FIG. 7*a* show a side view of the brush body with brush shaft and a brush disk welded to the brush body and an associated end view.
Figure 4A:
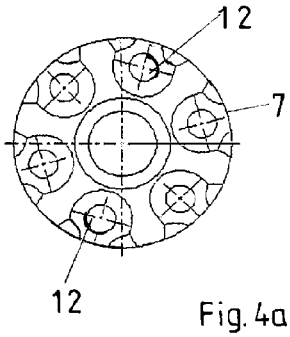

The claimed process serves for preparing a previously mechanically roughened surface on a metal workpiece 1 by brushing for the application of a thermally sprayed layer. Said process is distinguished by the fact that the surface 2 to be machined on the workpiece 1 is machined by hammer or percussion brushing using a rotating hammer or percussion brush 3 having a multiplicity of radially outwardly oriented percussion wires 4, in such a manner that the edges of the burrs are broken in order to improve the adhesion of the subsequently applied thermally sprayed layer or are at least partially bent over to form undercuts. The brush 3 rotates at a high rotational speed of about 3000 to 6000 revolutions per minute and, during the machining operation, is displaced laterally with the axis of rotation 13 thereof at such a constant parallel distance in relation to the surface 2 of the workpiece 1, and in such a manner, that the ends 5 of the percussion wires 4 distributed over the circumference of the brush 3 impinge on adjacent surface regions on the workpiece 1 in bursts at an oblique angle of less than 90° in quick succession.

In the case where the disclosed process is applied to the surface of a cylinder bore or liner (as seen in FIG. 1), the lateral displacement of the brush's axis of rotation 13 relative to the workpiece surface (as described in the preceding paragraph) is achieved by moving the axis 13 in a circle that is centered on and normal to the cylinder bore axis. In this manner, only a portion of the circumference of the cylinder bore or liner surface 2 is treated by the wires at any instant.

Figure 10:
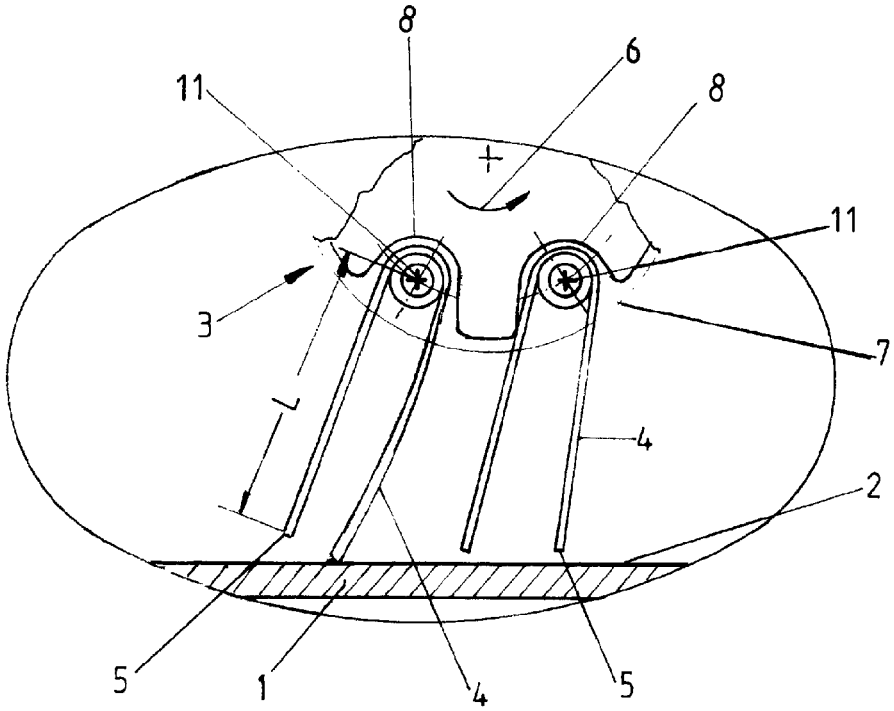
Figures 11, 12, 13, 14:
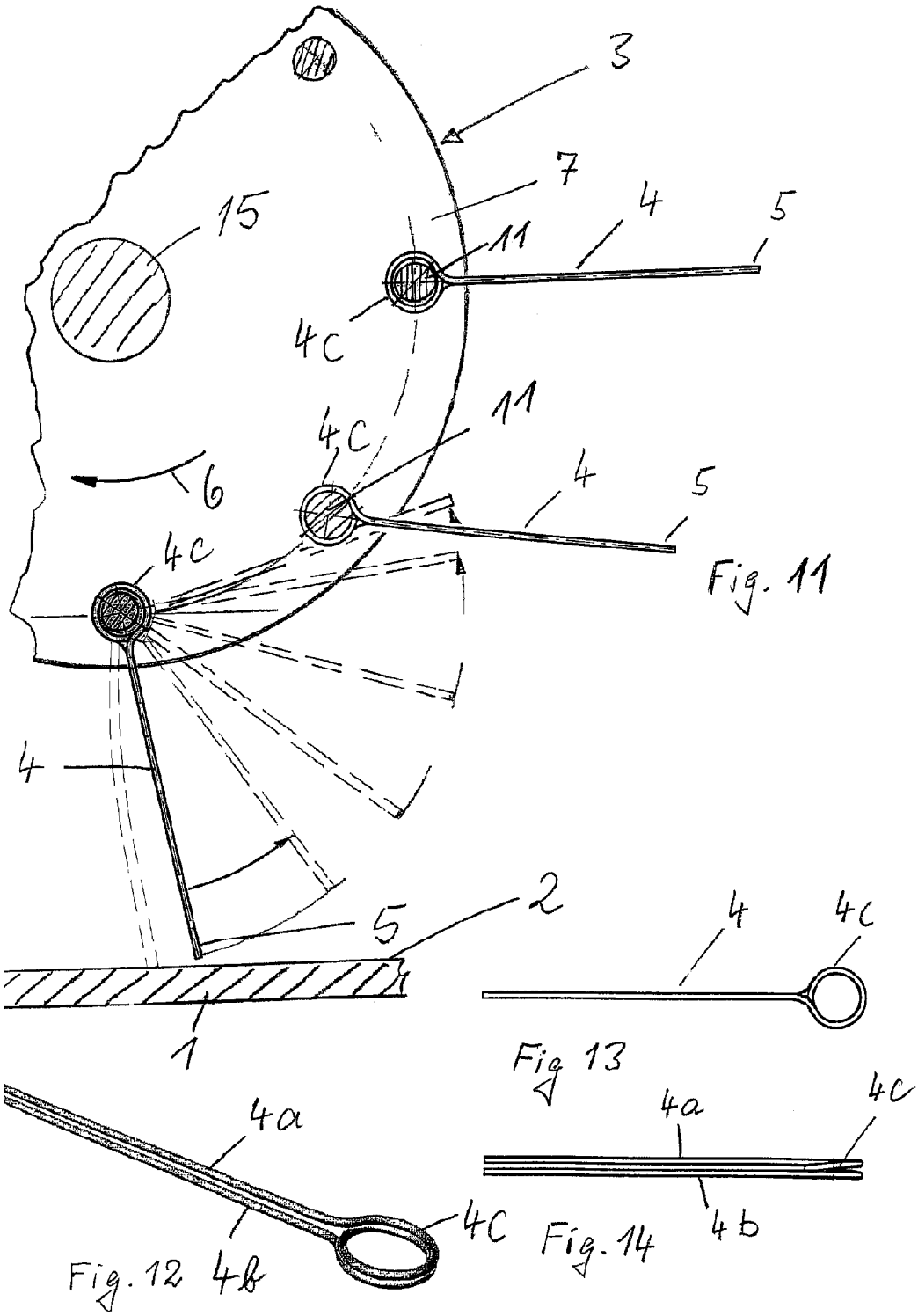
FIG. 11 shows a further embodiment of a hammer or percussion brush shown in FIG. 9 with modified percussion wires in the form of limb springs.
FIG. 12 shows a perspective illustration of one of the limb springs, FIG. 13 and FIG. 14 each show, in two associated longitudinal side views, one of the limb springs.

As shown in FIG. 10 and FIG. 11, the percussion wires 4 mounted on the brush body 7 so as to be freely rotatable in the direction of rotation 6 are bent resiliently when they impinge on the workpiece and slide along the surface to be machined with the ends 5 thereof, in order to then immediately be lifted off from the surface owing to the resilient bending and, when the brush 3 continues to rotate, to be thrown back counter to the direction of rotation 6, and then to return to their radial orientation for renewed surface contact as a result of the effect of centrifugal force.

As can likewise be seen in FIG. 10 and FIG. 11, the length of the percussion wires 4 of the brush is such that, when the brush is rotating rapidly and after the wires have impinged in bursts on the surface 2 to be machined, these can be pulled along part of said surface in the direction of rotation 6 of the brush 3, in order to then lift off from the machining surface again when the brush continues to rotate and to thus complete the percussion action.

In all the embodiments shown, the brush 3 comprises a substantially cylindrical, rotationally symmetrical brush body 7 having a multiplicity of axially parallel support bars 11, which are clamped over the circumference of the brush between brush disks 9, 10 positioned at the ends, and which each support a multiplicity of percussion wires 4 arranged close together in the axial direction of the brush 3.

Figure 9:
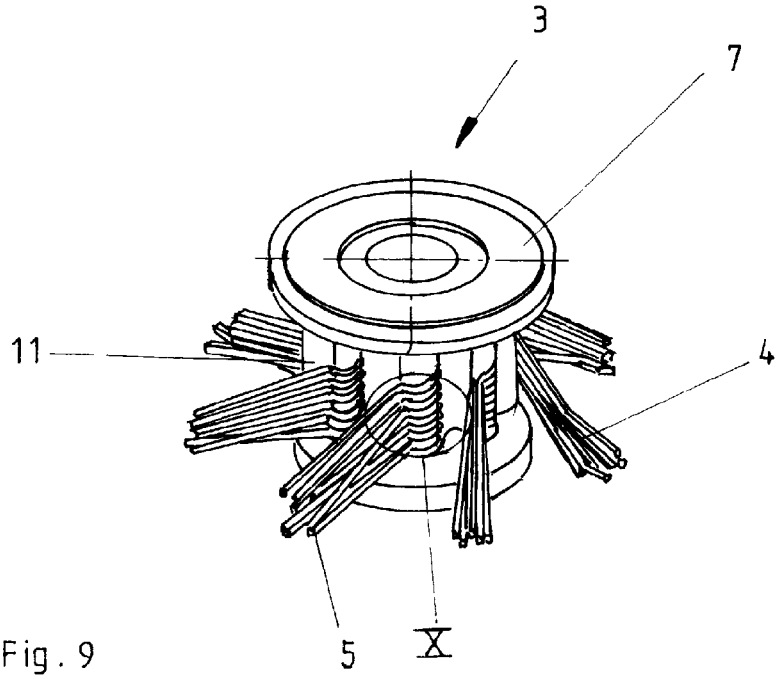
FIG. 9 shows a perspective view of a further embodiment of a hammer or percussion brush having a modified brush body.

In the embodiment shown in FIG. 1 to FIG. 8, the hammer or percussion brush 3 rotating at a high rotational speed comprises a substantially cylindrical, rotationally symmetrical brush body 7 having a multiplicity of axially parallel longitudinal channels 8, in each of which axially parallel support bars 11 (FIG. 1, FIG. 2 and FIG. 9) for a multiplicity of percussion wires 4 arranged close together in the axial direction of the brush are clamped between brush disks 9, 10 positioned at the ends. The hammer or percussion brush 3 shown has six longitudinal channels 8 which are uniformly distributed over the circumference of the brush body 7 and likewise have six support bars 11, on which the percussion wires 4 are mounted in a freely rotatable manner. The limbs 4*a*, 4*b* of the percussion wires 4 are each of the same length, and the support bars 11 have a round cross section such that the percussion wires 4 can move freely to and fro on the support bars 11 in the direction of rotation 6 of the brush. In the exemplary embodiment shown in FIG. 9 and FIG. 10, the percussion wires 4 have a U-shaped design with two spaced-apart, parallel limbs 4*a*, 4*b*, and therefore they encircle the support bar 11 with an annular eye 4*c*. The percussion wires 4 of the brush 3 are provided with a hard chromium plating containing about 53% Cr on the wire surface and having a Vickers hardness HV of at least 1800.

Figure 5:
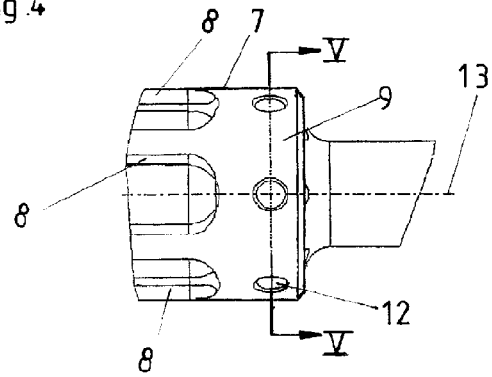
Figure 5A:
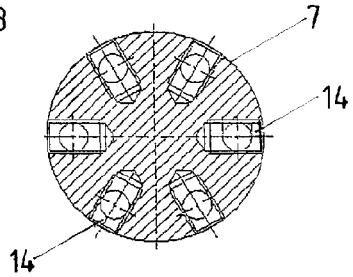
Figure 6:
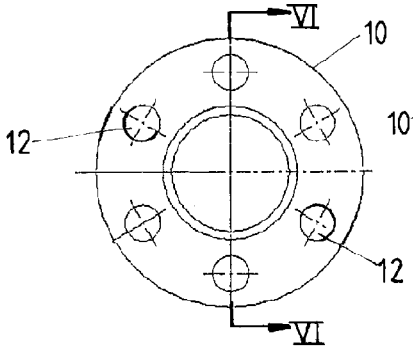
Figure 6A:
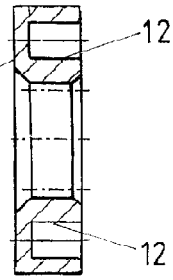
Figure 7:
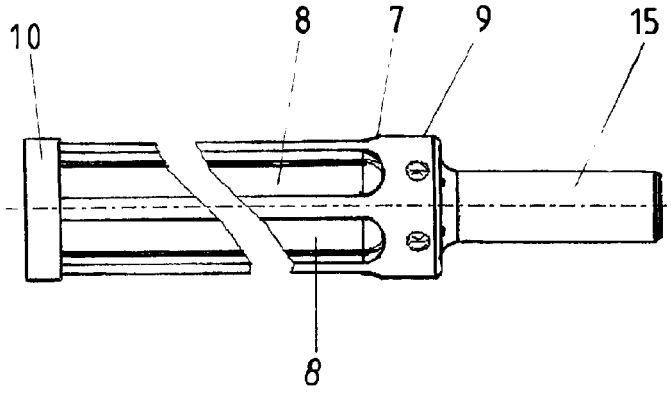
Figure 7A:
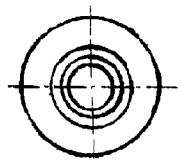
Figure 8:
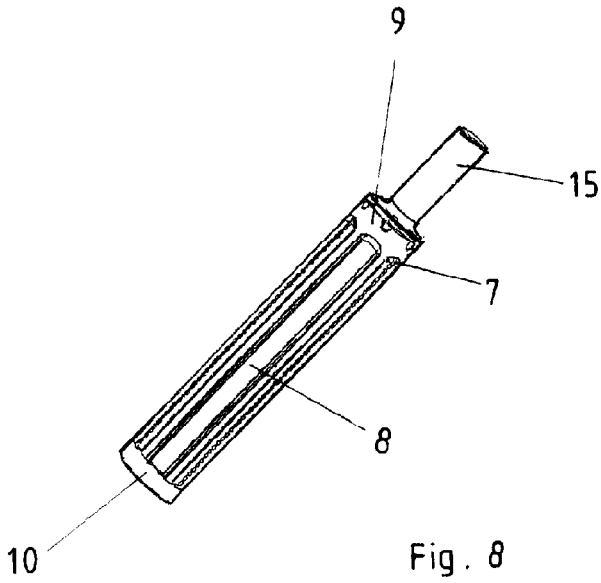
FIG. 8 shows a side view of the complete brush body with brush shaft and welded brush disk.

As is also shown in FIG. 5 and FIG. 5*a*, the receptacles 12 for the ends of the support bars 11 are formed on at least one brush disk 9 or 10 so as to be adjustable by means of adjustable bearing bushes 14 radially in relation to the axis of rotation 13 of the brush 3. In addition, the brush body 7 with brush disks 9, 10, support bars 11, percussion wires 4 and brush shaft 15 expediently consists of a high-strength, stainless high-grade steel.

In the further exemplary embodiment of a hammer or percussion brush shown in FIGS. 11 to 14, the percussion wires 4 are in the form of limb springs having parallel limbs 4*a*, 4*b* arranged close together in the axial direction of the support bars 11, and likewise encircle the support bars 11 with an annular eye 4*c*. When they impinge on the surface 2 to be machined, said percussion wires are bent and then spring back in the direction of an adjacent support bar 11 following counter to the direction of rotation 6.

In this exemplary embodiment, the brush body 7 comprises two brush disks 9, 10, which are fastened to the brush shaft 15 and to which the support bars 11 for the percussion wires or limb springs 4 are fastened at their two ends in receptacles 12 likewise distributed uniformly over the circumference of the brush body 7. In this case, too, the receptacles 12 for the ends of the support bars 11 may be adjustable on at least one brush disk 9 or 10 by means of adjustable bearing bushes 14 radially in relation to the axis of rotation 13 of the brush. Similarly, the brush body 7 with brush disks 9, 10, support bars 11, percussion wires or limb springs 4 and brush shaft 15 consists of a high-strength, stainless high-grade steel. In addition, the materials used for the brush have the same quality as for the brushes shown in FIG. 1 to FIG. 10.

Figure 15:
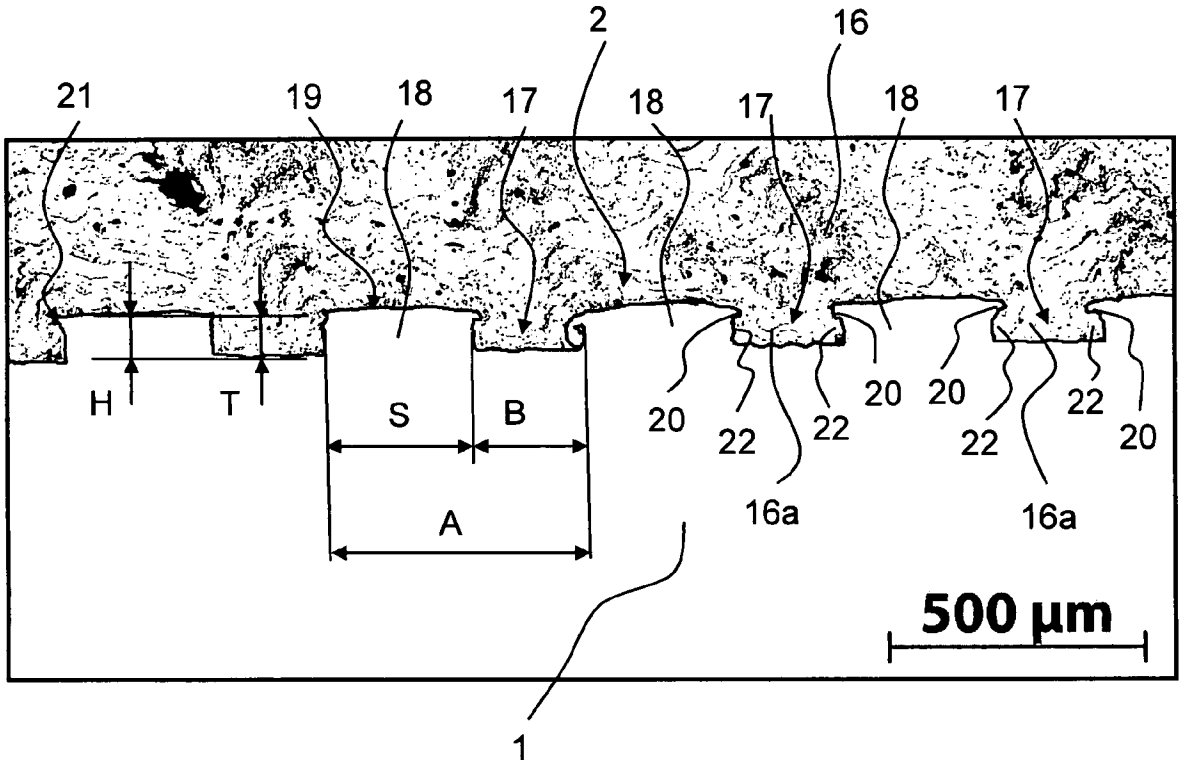
FIG. 15 shows a cross section through a surface according to the invention provided with a sprayed layer.

FIG. 15 shows a cross section through a surface 2, according to the invention, of a workpiece 1 provided with a sprayed layer 16, transversely in relation to the grooves 17. The groove webs 18 are located at regular intervals between the grooves 17. The grooves 17 are defined by the average groove width B thereof, the average groove spacing A thereof, the average width S of the groove webs 18, the average groove depth T and the average groove web height H, the groove spacing A corresponding to the sum of groove width B and width S of the groove webs 18, and the groove depth T being the same as the groove web height H. Here, "average" width or depth or height is intended to mean that a rough average value is formed by expressing the cross-sectional area of a groove 17 or of a groove web 18 in each case by two average values.

The plastic deformations 20 produced as a result of the percussion brushing on the groove edges 21 can be seen on the surfaces 19 of the groove webs 18, and the undercuts 22 are formed in the grooves 17 as a result of these deformations. Once the grooves 17 have been filled with the sprayed layer 16*a*, the sprayed layer 16 as a whole interlocks on these undercuts 22 and is thus firmly connected to the workpiece 1. It can be seen that the plastic deformations 20 occur irregularly transversely in relation to the grooves 17. This also applies in the longitudinal direction in relation to the grooves 17, where the plastic deformations 20 are introduced more or less frequently into the groove structure depending on the brushing intensity. Overall, this surface structure with the irregular undercuts 22 results in a very high adhesive strength of the sprayed layer 16 on the workpiece 1.

As can be gathered from the scale in FIG. 15, the grooves 17 roughly have a groove width B of 0.2 mm, a groove spacing A of 0.5 mm, thus a width S of the groove webs 18 of 0.3 mm and a groove depth T or groove web height H of 0.09 mm. This macroscopic structure, which is applied in a first process step, has a magnitude in the orders of magnitude preferred for these processes of 0.1-1 mm in width and about 0.05-0.2 mm in depth.

The plastic deformations 20 introduced by brushing in the second process step have microscopic dimensions of about 5-50 μm on the surface 19 of the groove webs 18. The plastically deformed surface 19 of the groove webs 18, in a manner similar to a shot-blasted surface, has a layer provided with residual compressive stresses.

LIST OF REFERENCE SYMBOLS

1 Workpiece
2 Surface
3 Hammer or percussion brush
4 Percussion wires—Limb springs
4*a* Limb of the percussion wires formed as limb springs
4*b* Limb of the percussion wires formed as limb springs
4*c* Annular eye of the percussion wires or limb springs
5 Ends of the percussion wires 4
6 Direction of rotation of the brush
7 Brush body
8 Longitudinal channels
9 Brush disk
10 Brush disk
11 Support bars—Axes
12 Receptacles for the support bars 11
13 Axis of rotation
14 Bearing bushes
15 Brush shaft
16 Sprayed layer
16*a* Sprayed layer in a groove
17 Grooves
18 Groove webs
19 Surfaces of the groove webs
20 Plastic deformation of a groove edge 21
21 Groove edge
22 Undercuts

The invention claimed is:

1. A process for preparing a surface of a cylindrical bore for application of a sprayed layer comprising:

forming a series of circumferentially-oriented alternating grooves and webs in the surface; and operating a rotary brush to plastically deform the webs, the brush having a central shaft and at least one wire having a base end mounted for rotation about an axis parallel with and radially offset from the central shaft such that an entire length of the wire is rotatable about the axis, the wire having a length such that an outside diameter of the rotary brush is less than an inner diameter of the cylindrical bore, and operation of the brush comprising:

positioning the central shaft parallel with and offset from a central axis of the cylindrical bore;

rotating the brush about the central shaft such that the wire strikes a circumferential sector of the bore surface, is pulled along the sector, and then lifts off from the surface; and moving the central axis in a circular pattern within the cylindrical bore to maintain a constant distance from the bore surface, such that the bore surface is contacted around its full circumference.

2. The process as claimed in claim 1, wherein the grooves have a trapezoidal to rectangular cross section.

3. The process as claimed in claim 1, wherein a diameter of the wires is greater than a groove width.

4. The process as claimed in claim 1, wherein a diameter of the wires corresponds to at least one times a groove spacing.

5. The process as claimed in claim 1, wherein a ratio of a groove depth to a groove width is between 0.2 and 1.

6. The process as claimed in claim 1, wherein a ratio of a groove spacing to a groove width is between 1.2 and 4.

7. The process as claimed in claim 1, wherein a groove spacing is between 0.1 mm and 1 mm.

8. The process as claimed in claim 1, wherein the brush comprises a plurality of axially parallel support bars arranged circumferentially with respect to the central shaft, each support bar rotatably supporting at least one wire.

* * * * *